US005197539A

United States Patent [19]

Hughes et al.

[11] Patent Number: 5,197,539

[45] Date of Patent: Mar. 30, 1993

[54] HEAT EXCHANGER WITH REDUCED CORE DEPTH

[75] Inventors: Gregory G. Hughes, Milwaukee; John E. Munch, Jr., Racine; C. James Rogers, Racine; Rodney A. Struss, Racine, all of Wis.

[73] Assignee: Modine Manufacturing Company, Racine, Wis.

[21] Appl. No.: 653,691

[22] Filed: Feb. 11, 1991

[51] Int. Cl.[5] ..... F28F 1/10; F28D 1/047

[52] U.S. Cl. ..... 165/172; 165/150

[58] Field of Search ..... 165/172, 173, 150; 29/890.053

[56] References Cited

U.S. PATENT DOCUMENTS

| | | | |
|---|---|---|---|
| 2,056,862 | 10/1936 | Markley, Jr. | 165/172 |
| 2,539,886 | 1/1951 | Bisch | 165/172 |
| 2,657,020 | 10/1953 | Hofmeister | 165/172 |
| 2,707,868 | 5/1955 | Goodman | 165/150 |
| 2,847,192 | 8/1958 | Smith et al. | 165/172 |
| 3,147,800 | 9/1964 | Tadewald | 165/150 |
| 4,615,383 | 10/1986 | Aoki | 165/172 |
| 4,619,024 | 10/1986 | McManus et al. | 165/172 |
| 4,966,230 | 10/1990 | Hughes et al. | 165/150 |

FOREIGN PATENT DOCUMENTS

| | | | |
|---|---|---|---|
| 2705178 | 9/1977 | Fed. Rep. of Germany | 165/150 |
| 2846549 | 5/1979 | Fed. Rep. of Germany | 165/172 |
| 3510406 | 9/1986 | Fed. Rep. of Germany . | |
| 152395 | 11/1980 | Japan | 165/172 |
| 1-69294 | 7/1989 | Japan | 165/185 |
| 123041 | 10/1927 | Switzerland | 165/172 |

*Primary Examiner*—John Rivell
*Assistant Examiner*—L. R. Leo
*Attorney, Agent, or Firm*—Wood, Phillips, VanSanten, Hoffman & Ertel

[57] ABSTRACT

The core depth of a heat exchanger having parallel, tube-like headers (10, 12; 62, 64) may be reduced through the use of a plurality of second heat exchange fluid conduits (26, 126) located in side by side relation and each having a first port (30, 60, 178) in fluid communication with one of the headers (12, 62) and a second port (32, 168, 174) in fluid commuication with the other of the headers (10, 64) and each defining a serpentine fluid flow path between the ports (30, 32, 166, 168, 174, 178) having a plurality of passes (36, 38, 40, 42, 44; 140, 142, 144, 146; 184, 186, 188) in side by side relation together with fins 28 embracing and bonded to the conduits (26, 126).

8 Claims, 3 Drawing Sheets

HEAT EXCHANGER WITH REDUCED CORE DEPTH

FIELD OF THE INVENTION

This invention relates to heat exchangers, and more particularly, to heat exchangers having a core made up of finned conduits through which one heat exchange fluid passes while a second heat exchange fluid passes through the core itself in heat exchange relation to the fins.

BACKGROUND OF THE INVENTION

One common form of a heat exchanger includes a so-called "core" made up of tubes and interconnecting fins. One heat exchange fluid is passed through the tubes of the core while a second heat exchange fluid is passed through the core itself in the spaces between adjacent fins.

In the usual case, at opposite sides of the core, there are located inlet and outlet "tanks" or manifolds. The tanks are in fluid communication with the interior of the tubes and arranged so that some desired flow path through the tubes is achieved.

Heat exchangers of this general sort may be used for a large variety of purposes. A typical use is as a radiator in a vehicle which serves to cool coolant for the engine. In the usual case, the vehicle coolant system will be operating at a relatively low pressure allowing the use of thin walled tubes in the core with an ultimate consequence that compactness of the core is relatively easily achieved. Where, however, heat exchangers of the general sort described above are used in higher pressure applications as, for example, a condenser in a refrigeration system, thinned wall tubes of the sort useful in vehicular radiators are of insufficient strength to withstand the pressure of the compressed refrigerant directed to the condenser to condense therein. Consequently, in such uses, resort has been made to thicker walled tubes. In order to minimize the wall thickness and thus material requirements of such tubes, it has also been typical that such tubes have a circular cross section to provide increased hoop strength sufficient to withstand the pressures involved.

Further, in applications such as refrigerant condensers, it is frequently advantageous to provide for multiple passes of the tube bound fluid through the core. This in turn means that the tubes must emerge from one end of the core and be redirected through the core. In some instances, this has been accomplished through the use of 180° elbows while in others it has been accomplished simply by bending the tube 180°.

In either event, a considerable radius in the elbow or the bend has been required to prevent kinking of the tube or otherwise restricting flow as the tube bound heat exchange fluid reverses its direction by 180°. This, in turn, has required that the tubes that run through the core be spaced from one another a distance equal to approximately twice the radius of curvature of the elbow or the bend. The typical result is an increase in the depth of the core.

Increased core depths, depending upon a fin structure employed, may result in increased so-called "air side" pressure drop which will increase system energy requirements if the heat exchange fluid flowing through the core must be propelled therethrough by means of a fan or the like. Perhaps even more importantly, the increased core depth means that the total volume occupied by the heat exchanger will be proportionally increased; and in many applications, particularly in vehicles, the increased volume and accompanying increased weight simply cannot be tolerated The present invention is directed to overcoming one or more of the above problems.

SUMMARY OF THE INVENTION

It is the principal object of the invention to provide a new and improved heat exchanger. More particularly, it is an object of the invention to provide a multi-pass heat exchanger with a minimal core depth.

An exemplary embodiment of the invention achieves the foregoing objects in a heat exchanger including a pair of generally parallel, tube-like headers. An area to one side of each of the headers defines a gas flow plane for a first, gaseous heat exchange fluid. A plurality of second heat exchange fluid conduits ar located in side by side relation and each has a first port in fluid communication with one of the headers and a second port in fluid communication with the other of the headers. Means define a serpentine fluid flow path extending between the ports which has a plurality of passes in fluid series with each other. Each pass extends from one side of the area across the area to the opposite side and the passes of each such conduit are further arranged in side by side relation such that the associated conduit is nominally transverse to the plane. Fins embrace and are bonded to the conduits within the area.

In one embodiment of the invention, each such conduit is defined by an elongated tube bent upon itself.

In a highly preferred embodiment, each of the passes of each such tube are in substantial abutment with at least one other pass of the associated tube.

The invention contemplates that the ends of adjacent passages of each tube be joined by integral loops of generous radii and that the loops be twisted at an angle located between the plane and the transverse passes to enable the passes to be in substantial abutment without kinking the tube at the loops.

According to another embodiment of the invention, each of the fluid conduits is defined by an extrusion having an elongated cross section and a hollow center. Elongated webs are located within the extrusion and divide the hollow center into the plurality of passes.

This embodiment also contemplates the provision of caps on opposite ends of each of the extrusion with one of the caps for each extrusion having at least one of the ports therein.

This embodiment of the invention also comprehends the inclusion of means at the interface of each extrusion and its associated caps for placing the respective passes in fluid series with one another.

In one embodiment of the invention, the headers are on opposite sides of the area. This in turn will provide for an odd number of passes.

In another embodiment of the invention, the headers are in close proximity to one another and are located on a common side of the area. In this embodiment of the invention, an even number of passes are provided.

Other objects and advantages will become apparent from the following specification taken in connection with the accompanying drawings.

DESCRIPTION OF THE PREFERRED EMBODIMENTS

Figure 2:
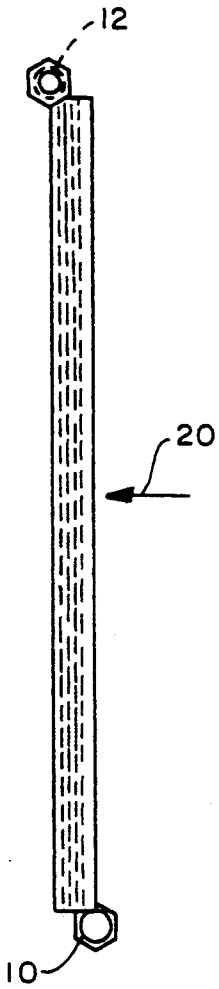
FIG. 2 is a side elevation of the heat exchanger.

Exemplary embodiments of the invention are illustrated in the drawings and it will be appreciated from the following description that the same are ideally suited for use in high pressure applications as, for example, condensers in refrigeration (including air-conditioning) systems. However, no limitation to their use as condensers is intended except insofar as may be stated in the claims hereof.

Figure 1:
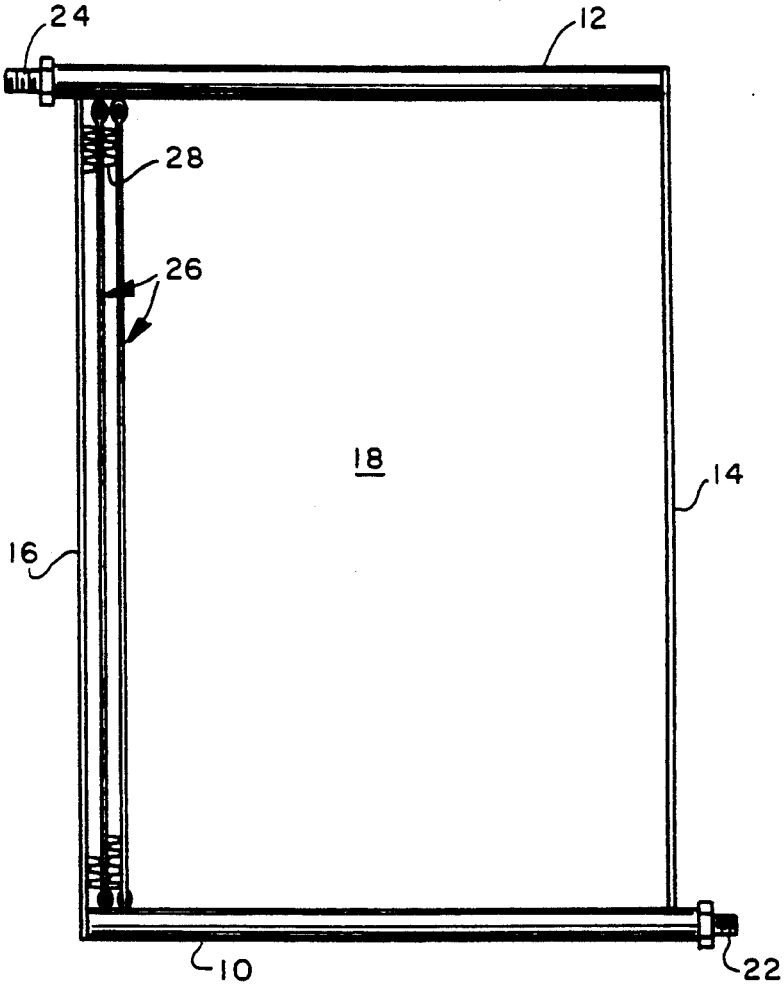
FIG. 1 is a front elevation of one embodiment of a heat exchanger made according to the invention.

Referring to FIG. 1, a typical heat exchanger includes first and second tube-like headers 10 and 12. Preferably, the headers 10 and 12 have a circular cross section for resistance to high pressures. As illustrated in FIG. 1, the headers 10 and 12 are parallel to each other and, together with side pieces 14 and 16 extending between the headers 10 and 12, bound an area 18 which is planar and through which a gaseous heat exchanger fluid, typically air, will pass in the direction of an arrow shown in FIG. 2.

At one end, the header 10 includes a threaded fitting 22 which may serve as an outlet from the heat exchanger while at the opposite end, the header 12 includes a similar fitting 24 which serves as an inlet.

Between the side pieces 14 and 16, a plurality of conduits, generally designated 26, extend. The conduits 26 have respective ends in fluid communication with the headers 10 and 12 and are spaced from one another so that serpentine fins 28 may be interposed between and bonded to adjacent conduits 22 and/or the side pieces 14, 16 at the ends to define a conventional heat exchanger core.

Figure 3:
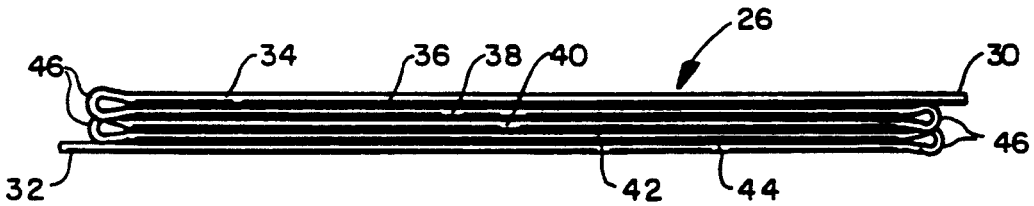
FIG. 3 illustrates one embodiment of a conduit usable in the heat exchanger and made up of a tube bent upon itself.
Figure 4:
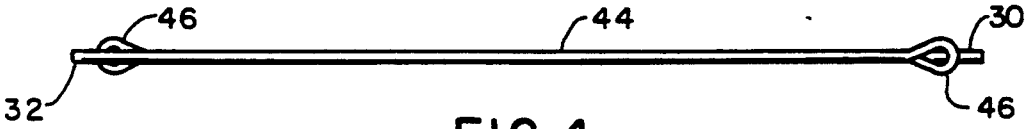
FIG. 4 is a view similar to FIG. 3, but taken at 90° thereto.

FIG. 3 shows one conduit 26 rotated approximately 90° in the clockwise direction from the position illustrated in FIG. 2. The conduit 26 includes one end 30 which is in fluid communication with the interior of the header 12 and an opposite end 32 which is in fluid communication with the interior of the header 10. In the embodiment illustrated in FIGS. 1–7, each conduit 26 is made up of an elongated length of tubing, typically of circular cross section. For example, a 0.125 inch O.D. tube may be employed. As illustrated in FIG. 3, the tube 34 is bent upon itself to form five parallel runs 36, 38, 40, 42 and 44. As seen in FIG. 3, the runs 36, 38, 40, 42, 44 are in abutment with one another and as can be seen from FIG. 4, the same are coplanar. Further, the plane defined by the runs 36, 38, 40, 42, 44 is transverse to the plane of the area 18.

As can be seen in the various figures of drawing, adjacent runs 36, 38, 40, 42 and 44 are interconnected at the ends of the core by integral loops 46 formed by bends in the tube 34. The loops 46 have a generous radius in comparison to the outer diameter of the tube 34 and where the latter is 0.125 inches, the radius of each of the bends defining the loops 46 will likewise be 0.124 inches.

Figure 5:
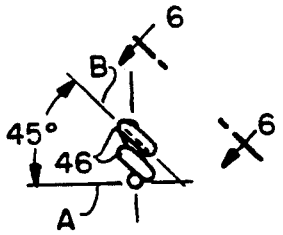
FIG. 5 is a fragmentary plan view of one end of the conduit shown in FIG. 3.

As can be seen in FIG. 3, adjacent loops 46 on each end of the conduit 26 overlap one another. This is required in order to allow the runs 36, 38, 40, 42 and 44 to be in substantial abutment with one another. Because, however, these same runs define a plane, in order to achieve overlapping, it is necessary that the loops 46 be twisted. Thus, FIG. 5 shows the loops 46 twisted to a forty-five degree angle, that is, midway between a plane A defined by the area 18 and a plane B defined by the coplanar passes or runs 36, 38, 40, 42 and 44.

Figure 6:
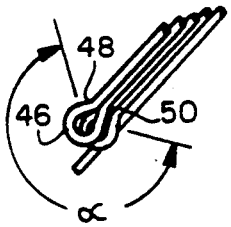
FIG. 6 is a fragmentary side view of an end of the conduit taken from an angle midway between the views of FIGS. 3 and 4.

As can be seen from FIG. 6, and further to serve the purpose of allowing substantial abutment of the passes 36, 38, 40, 42 and 44, each bend forming a loop 46 extends through an angle, which is substantially greater than 180° and terminates in two small reverse bends 48 and 50 on opposite sides of the main loop 46 to bring the associated run into the plane of the other runs.

Figure 7:
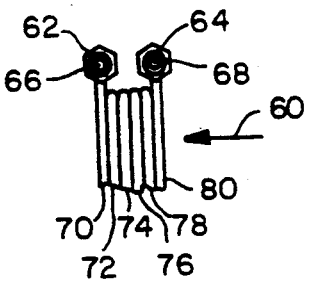
FIG. 7 is a fragmentary view like FIG. 2, but of a modified embodiment of the invention.

In the embodiment illustrated in FIGS. 1–4, wherein the ends 30 and 32 of the tube 34 are at opposite ends of the conduit structure 26, there will be an odd number of passes or runs across the area 18. Where an even number of runs are desired, rather than locating the headers 10 and 12 on opposite sides of the area 18, the same are located on a common side such that the area 18 extends away from both. Such a structure is illustrated in FIG. 7 where airflow is in the direction of an arrow 60, and an inlet conduit shown at 62 and an outlet conduit shown at 64. Both are provided with fittings 66 and 68 similar to the fittings 22 and 24. As can be seen, this embodiment of the invention includes six runs or passes 70, 72, 74, 76, 78 and 80.

As many passes as are desired may be easily provided simply by increasing the number of runs and adding additional loops are required.

Figure 8:
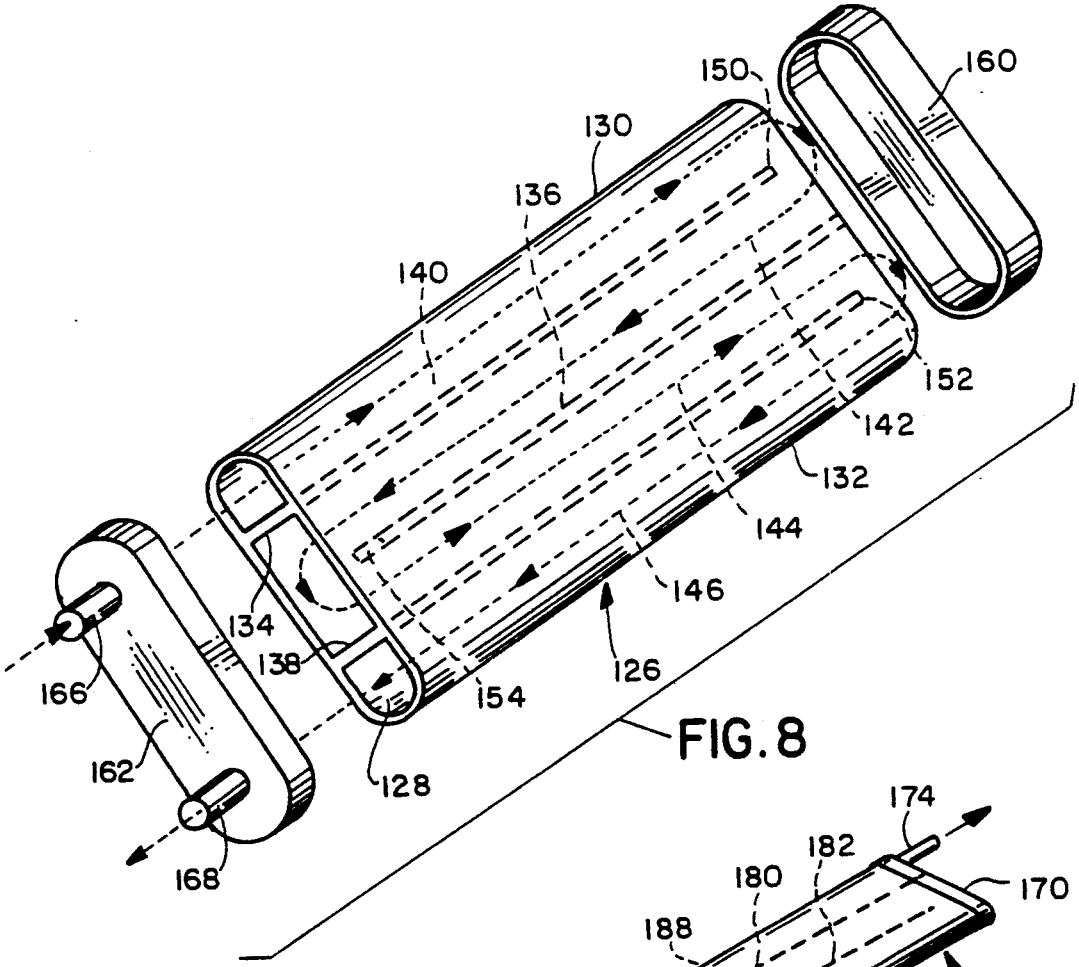
FIG. 8 illustrates a modified embodiment of a fluid conduit useful in the heat exchanger

A modified form of conduit is illustrated in FIG. 8. Here, the conduit is generally designated 126 and is formed of an elongated extrusion having a hollow center 128 that in turn is elongated from one side 130 to the opposite side 132 of the extrusion 126. A plurality of webs, three in FIG. 8, are shown at 134, 136 and 138 in spaced relation within the hollow center. As a consequence of this construction, four passes 140, 142, 144 and 146 within the conduit 126 are provided, the same being separated from one another by the webs 134, 136 and 138. To provide for a serial flow path, one end 150 of the web 134 is relieved or recessed. The corresponding end 152 of the web 138 is similarly relieved while the opposite end 154 of the web 136 contains a similar relief.

The hollow center 128 of the extrusion is closed off by a pair of end caps 160 and 162. The same may be formed by any suitable means. Where aluminum is the material utilized, impact extrusion is a convenient method by which the same may be formed.

The end cap 160 serves mainly to direct fluid in the pass 140 about the relief 150 to the pass 142 and to direct fluid in the pass 144 about the relief 152 to the pass 146.

The end cap 162 serves to direct fluid in the pass 142 to the pass 144 about the relief 154. In addition, the same includes integral nipples 166 and 168 which are respectively aligned with the passes 140 and 146 to serve as inlet and outlet ports respectively.

Figure 9:
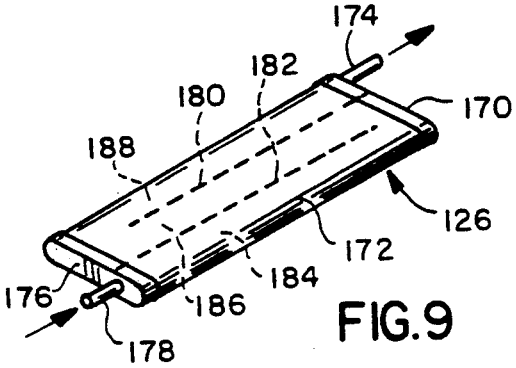
FIG. 9 illustrates still another form of conduit that may be utilized in the invention.

It will thus be appreciated that the structure illustrated in FIG. 8 provides an even number of passes, specifically four, and would be arranged with the nipples 166 and 168 in respective, adjacent headers such as the headers 62 and 64 shown in FIG. 7.

Where an odd number of passes are to be utilized with an extrusion formed conduit, an extrusion having an even number of spaced webs in its hollow center would be utilized with corresponding ends of every second web having the relief as illustrated. In such a case, an end cap such as shown at 170 would be placed on one end of the extrusion 172 and provided with a port or nipple 174 which may serve as an outlet. The opposite end cap 176 would include a nipple 178 diametrically oppositely from the nipple 174 to serve as an inlet. The interior webs for a three pass unit are shown schematically at 180 and 182 to define three passes 184, 186 and 188. The conduit shown in FIG. 9 would, of course, be utilized with a header system such as shown in FIGS. 1 and 2.

In some instances, the reliefs in the ends of the webs might be dispensed with in favor of the use of partitions within the end caps themselves. The essential point is that the means that are utilized to establish serial flow be located at the interface of the end caps and the extrusion.

Figure 10:
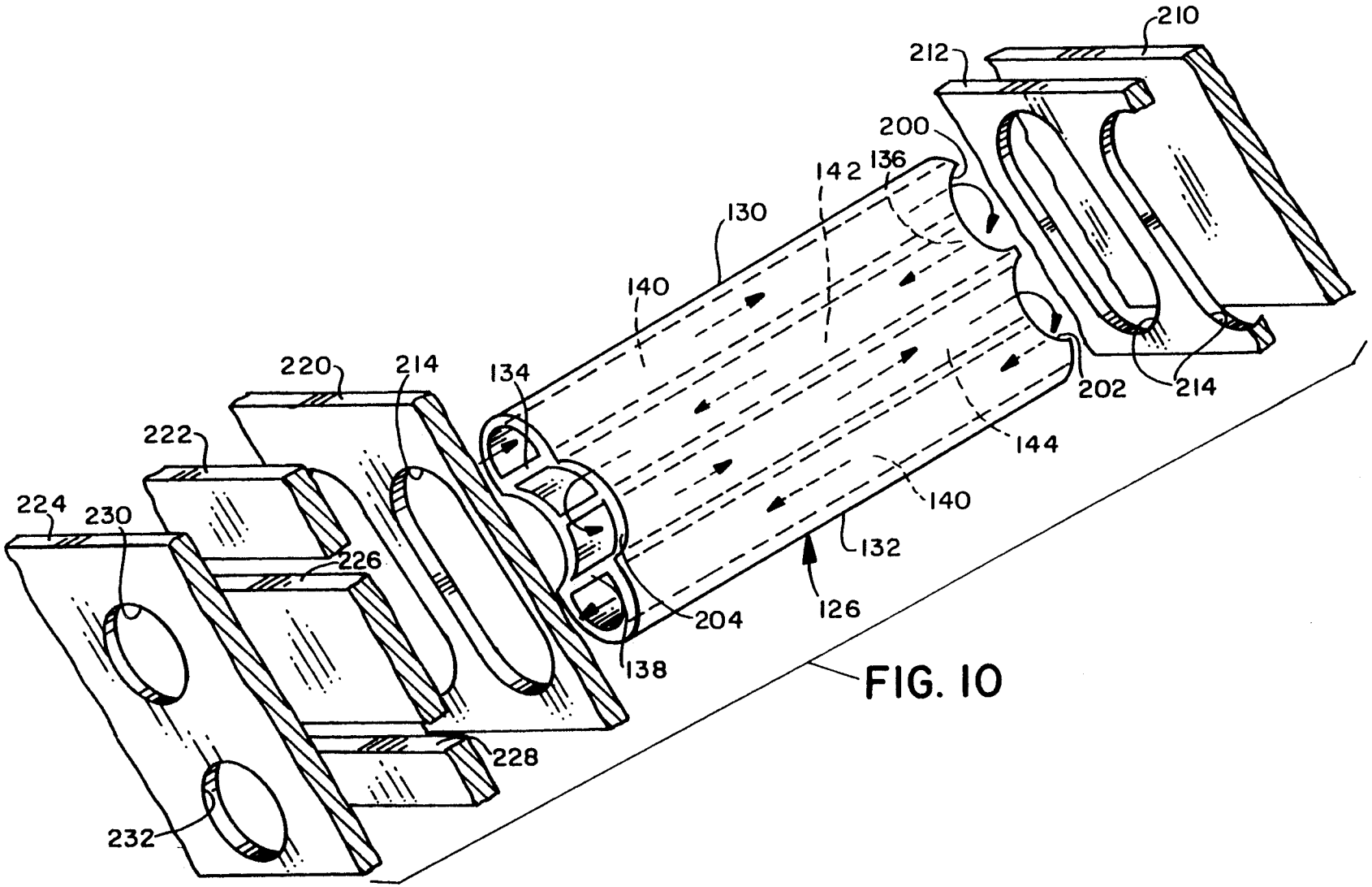
FIG. 10 illustrates a further modified embodiment of a fluid conduit useful in the heat exchanger.

FIG. 10 illustrates an embodiment like that illustrated in FIG. 8, but achieves structures equivalent to the reliefs 150, 152 and 154 by other means. More particularly, rather than introducing a tool into the ends of the conduit 126 to provide the reliefs, the same may be formed by grinding, milling, punching or otherwise removing part of the opposed side walls in the vicinity of the webs 134, 136 and 138 where desired adjacent the ends of the conduits 26. As illustrated in FIG. 10, an arcuate segment of the opposed side walls of the conduit 126, including the end of the partition 134 adjacent the end cap 160 has been removed by a cut 200. A similar cut 202 has been employed at the same end of the conduit 126 to remove part of the partition 138.

At the left hand end of the conduit 126, an identical cut 204 has been employed to remove part of the partition 136 thereat.

While the cuts 200, 202 and 204 are shown at being circular, other shapes may be employed, depending upon how the cut is to be formed.

If end caps such as the end caps 160 or 162 shown in FIG. 8 are utilized at the ends of the conduit 126, it is important that the cuts 200, 202 and 204 do not extend into a corresponding end of the conduit 126 to a depth closely approaching the maximum depth of insertion of the corresponding end of the conduit 126 into the end caps 160 or 162 to avoid leakage. In short, when such is done, the cuts 200, 202 and 204 will be covered up entirely so that upon brazing, soldering or welding of the components into a unitary assembly, a sealed joint will result.

FIG. 10 also illustrates an improved manifold or header system whereby the end caps 160 and 162 may be omitted entirely.

In lieu of the end cap 160, a pair of elongated plates 210 and 212 are provided. The plates 210 and 212 have a width that is somewhat greater than the distance between the sides 130 and 132 of the conduit 126 and a length that corresponds to one frontal dimension of the heat exchanger. The plate 210 is imperforate while the plate 212 includes a series of oval apertures 214. The apertures 214 are spaced according to the desired spacing of the conduits 126 one from another and sized to snugly receive the end of the conduit 126 having the cuts 200 and 202. In addition, the thickness of the plate 212 is at least somewhat greater than the depth of the cuts 200 and 202.

In practice, a plurality of the conduits 126 are fitted to corresponding ones of the apertures 214 and brought into abutment with the plate 210 which in turn is abutting the side of the plate 212 opposite the conduits 126. The assemblage may be maintained in this configuration by a suitable fixture and the components brazed, welded or soldered together. The central partition or web 136 in the conduit 126 will be in abutment with the plate 210 and thus assure flow of the heat exchange fluid in the manner mentioned previously.

At the end of the conduits 126 opposite the plates 210 and 212 is a series of three plates 220, 222 and 224. The plate 220 may be identical to the plate 212 and is fitted to the end of the conduits 126 containing the cuts 204. Again, the thickness of the plate 220 must somewhat exceed the depth of the cuts 204 to ensure the absence of any leak.

The plate 222 includes first and second elongated slots 226 and 228. The slot 226 aligns with that part of a conduit 126 between the side 130 and the partition or web 134 while the slot 228 aligns with that part of the conduit 126 between partition 138 and the side 132. The ends of the partitions 134 and 138 will abut an imperforate region of the plate 222.

The late 224 includes an inlet port 230 which aligns with the slot 226 and an outlet port 232 which aligns with the slot 228. Nipples or other fixtures (not shown) may be placed in the ports 230 and 232.

Again, the plates 220, 222 and 224 are assembled in abutment with one another and on the ends of the conduits 126 containing the cuts 204. The same are then soldered, brazed or welded together to seal the various interfaces. In this case, the slot 226 acts as a distribution header channel on the inlet side of the resulting heat exchanger, distributing incoming heat exchange fluid between a plurality of the openings 214 in the plate 220 while the slot 228 serves as an outlet header channel receiving heat exchange fluid from a plurality of the openings 214. Short circuiting is avoided by the fact that the ends of the partitions or webs 134 and 138 abut the imperforate center of the plate 222 to provide a seal thereat after welding, brazing or soldering.

While the header system illustrated in FIG. 10 is employed in a four pass system, it will be appreciated that the same can be employed, in substantially identical form, to any heat exchanger having an even number of passes. It may also be employed in a heat exchanger having an odd number of passes simply by providing an additional plate between the plates 210 and 212. One of the slots 226 or 228 is then removed from the plate 222 and placed in such additional plate while one of the ports 230 or 232 is removed from the plate 224 and placed in the plate 210 in alignment with the removed slot in the intermediate plate.

Finally, it will be appreciated that the header system illustrated in FIG. 10 may also be employed with conduits such as those illustrated in FIGS. 1 through 7, inclusive. In such a case, each of the openings 214 are replaced with one or more apertures for receiving a corresponding end of the tubes making up the conduits in the embodiment of FIGS. 1 through 7.

It will be further appreciated that through the use of an extrusion with spaced interior webs, the adjacent passes are placed in substantial abutment with one another and, like the configuration of the tubing 34 illustrated in FIGS. 3–6, inclusive, provide a compact multipass conduit which enables the heat exchanger to be made with a minimum core depth. It will likewise be appreciated that where the inlet is located on the side of the core remote from the direction of incoming gas as shown by the arrows 20 or 60, the advantages of so-called counter-cross flow are achieved as the fluid flowing within the conduits is moving from the back toward the front of the core as the other heat exchange fluid moves from the front toward the back.

We claim:

1. A heat exchanger comprising:

A pair of generally parallel headers;

an area of one side of each of said headers defining a gas flow plane for a first, gaseous heat exchange fluid;

a plurality of second heat exchange fluid conduits in side by side relation and each having a first port in fluid communication with one of said headers, a second port in communication with the other of said header and means comprising an elongated tube bent upon itself defining a serpentine fluid flow path extending between said ports and having a plurality of passes in fluid series with each other and each extending from one side of said area across the area to the opposite side thereof, each of the passes of each said tube being in abutment with at least one other pass of the associated tube, the passes of each said tube further being arrayed in side by side relation and such that the associated conduit is nominally transverse to said plane; and fins embracing said conduits within said area.

2. The heat exchanger of claim 1 wherein the ends of adjacent passes of each tube are joined by integral loops and said loops are twisted an angle located between said plane and said transverse passes to enable said passes to be in substantial abutment without kinking said tube at said loops.

3. The heat exchanger of claim 1 wherein said pair of headers are defined by separate tubes.

4. The heat exchanger of claim 1 wherein said fins are serpentine fins extending between and bonded to adjacent ones of said conduits and the passes of the tubes thereof.

5. A heat exchanger comprising:

first and second elongated headers of generally circular cross section and disposed generally in parallel with one another, each said header being along a side of a planar heat exchange area through which a first heat exchange fluid is adapted to pass in a direction generally mutually transverse to said headers and to the plane of said area; and a plurality of tubes of lesser cross section in side by side relation and extending between said headers in fluid parallel with one another, each said tube being folded upon itself to define a plurality of at least three serially connected passes across said area, each pass being in abutment with at least one other pass of the corresponding tube, the passes of each tube being nominally coplanar in a plane generally transverse to the plane of said area.

6. The heat exchanger of claim 5 further including serpentine fins extending between adjacent ones of said tubes and located in the plane of said area.

7. The heat exchanger of claim 5 wherein said passes of each tube are connected by a loop of generous radius and an arcuate extent of substantially more than 180°, said loops being twisted to an angle intermediate said planes so that said passes may be in said substantial abutment without kinking said tubes.

8. The heat exchanger of claim 7 wherein said angle is nominally about 45° to each of said planes.

* * * * *